US010624425B2

(12) United States Patent
Chen

(10) Patent No.: US 10,624,425 B2
(45) Date of Patent: Apr. 21, 2020

(54) BELT BUCKLE STRUCTURE

(71) Applicant: Hsi-Hsin Chen, Zhonghe (TW)

(72) Inventor: Hsi-Hsin Chen, Zhonghe (TW)

( * ) Notice: Subject to any disclaimer, the term of this patent is extended or adjusted under 35 U.S.C. 154(b) by 0 days.

(21) Appl. No.: 16/361,246

(22) Filed: Mar. 22, 2019

(65) Prior Publication Data

US 2019/0365056 A1 Dec. 5, 2019

Related U.S. Application Data

(63) Continuation-in-part of application No. 15/937,854, filed on Mar. 27, 2018, now abandoned.

(30) Foreign Application Priority Data

Sep. 15, 2017 (CN) ..... 2017 1 0834229
Dec. 10, 2018 (CN) ..... 2018 2 2065893 U

(51) Int. Cl.
*A44B 11/12* (2006.01)

(52) U.S. Cl.
CPC ..... *A44B 11/12* (2013.01)

(58) Field of Classification Search
CPC ..... A44B 11/2588; A44B 11/12
See application file for complete search history.

(56) References Cited

U.S. PATENT DOCUMENTS 2,775,011 A * 12/1956 Beuchat ..... A44B 11/24 24/178
2,904,866 A * 9/1959 Carter ..... A44B 11/2526 24/170
3,142,103 A * 7/1964 Lindblad ..... A44B 11/2526 24/638
3,454,995 A * 7/1969 Schleer ..... B60R 22/324 24/645
4,406,043 A * 9/1983 Friedman ..... A44B 11/006 24/171
5,588,184 A * 12/1996 Chen ..... A41F 9/007 24/170
9,173,454 B2 * 11/2015 Liu ..... A44B 11/006
9,930,936 B2 * 4/2018 Liu ..... A44B 11/006
2010/0058562 A1 * 3/2010 Aveni ..... A44B 11/20 24/190
2015/0040356 A1 * 2/2015 Chang ..... A44B 11/22 24/188

* cited by examiner

*Primary Examiner* — Robert Sandy
*Assistant Examiner* — David M Upchurch
(74) *Attorney, Agent, or Firm* — Leong C. Lei

(57) ABSTRACT

A belt buckle structure includes a buckle body and a plate-based controller. The buckle body is provided with a coupling section and a connection section at two ends thereof. The coupling section is formed with a pivoting notch in a top side and a recess in a bottom side. A pin hole is formed in each of two sides of the buckle body. The plate-based controller includes a coupling axle having a pawl. The coupling axle is arranged in the coupling section. A fixing member has a protruding section fit into the recess. A pin is received through the pint hole to penetrate through the recess and extend into a positioning hole of the fixing member. A primary constraint frame has two side portions collaborating with the pin to attach to two sides of the buckle body.

4 Claims, 6 Drawing Sheets

BELT BUCKLE STRUCTURE

CROSS-REFERENCE TO RELATED APPLICATION

This is a continuation-in-part of co-pending U.S. patent application Ser. No. 15/937,854 filed on Mar. 27, 2018.

(a) TECHNICAL FIELD OF THE INVENTION

The present invention relates generally to a belt buckle structure.

(b) DESCRIPTION OF THE PRIOR ART

Two styles of belt are commonly used, which are respectively prong clasping style and automatic fastening style. The automatic fastening style uses a pawl provided on a buckle to engage teeth formed in a toothed strap to achieve fastening of the belt so as to enable a user to wear and use.

The buckle of the automatic fastening style belt that is currently available in the market often involves, in the structure thereof, a button or handle for pressing or pulling to release the pawl for adjustment of the fastening location of the belt. Such an adjustment structure is affected by the size of the buckle and is usually made up of tiny parts, which makes operation inconvenient and often cause over-tight fastening, eventually leading to hard releasing and adjusting of the belt.

Although belt manufacturers have later proposed improvements for such issues of inconvenience, those improvements generally focus on regulation or adjustment speed and easy operation and require an increase of parts of the belt buckles that also complicate the structure. Consequently, failure and inconvenience of operation may result due to certain tiny parts.

An example is provided in U.S. Pat. No. 5,588,184, which discloses a hole-free belt that involves a skid-preventing and positioning mechanism, which, speaking in a simple way, includes a spring that works with a belt catch (6) and a feature that two ends of the belt catch (6) are of an acute design is adopted so that a belt catch holder (2) is operable to drive, in a resilient manner, the belt catch (6) to achieve positioning and a stop wall (61) provided in the belt catch holder (2) and strip-like positioning teeth (31) provided on a belt (3) could work together to constrain a range of moving for the belt catch (6). A conclusion can be easily made from the drawings of such a patent that, for carrying out an operation of adjustment, a force must be applied with the belt catch holder (2) in a direction toward the belt of a user in order to make the adjustment.

Apparently, the direction of force application is not of a design of ergonomics and as such, over application of force may readily occur, leading to damages. In addition, the belt catch (6) is made in a unique configuration that only works with a belt (3) that is provided with strip-like positioning teeth (30) for engagement and stop or prevent skidding therebetween. In practical uses, adjustment of such a belt catch holder (2) is in fact not convenient for users. Thus, further improvements are required.

SUMMARY OF THE INVENTION

An objective of the present invention is to provide a belt buckle structure that overcomes the drawbacks of the prior art devices.

The present invention provides a belt buckle structure, of which the primary technical objective is to include an integrally formed plate-based controller, which is arranged in a coupling section of the buckle body by means of a coupling axle of the plate-based controller. The coupling section is formed, in a central portion of a top side thereof, with a pivoting notch, and the coupling section is also formed, in an internal portion of a bottom side thereof, with a recess, wherein a protruding section of a fixing member is fit into the recess formed in the bottom side of the coupling section to set the plate-based controller in a rotatable condition as being enclosed and a pivot pin is received through a pivot hole provided in a side of the buckle body to extend into a positioning hole of the fixing member and two side portions of a primary constraint frame are arranged in collaboration with the pivot pin to attach to two sides of the buckle body so that all the parts are concealed and not exposed and thus, protectability of the overall structure is improved.

A secondary technical objective of the present invention is that the plate-based controller is further provided with a secondary constraint frame, through which a tail end section of a belt is insertable into the primary constraint frame such that by pressing down the primary constraint frame, the plate-based controller is caused to drive the pawl to move upward and downward in the pivoting notch. The tail end section of the belt is set in a fixed condition as being engaged by the pawl that is moved upward. When the pawl is moved downward, the tail end section of the belt is set in a released and thus adjustable condition as being disengaged from the pawl.

Thus, the present invention provides a belt buckle structure, which enables a belt to readily disengage therefrom through depression, in which an integrally formed plate-based controller in combined, through collaboration with a fixing member, with a buckle body, so that the number of connecting parts of the plate-based controller is significantly reduced and complication of assembling is improved, and fixing can be realized by means of a pin and a primary constraint frame to have all parts concealed and not exposed and thus protectability and aesthetics of the overall structure are improved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
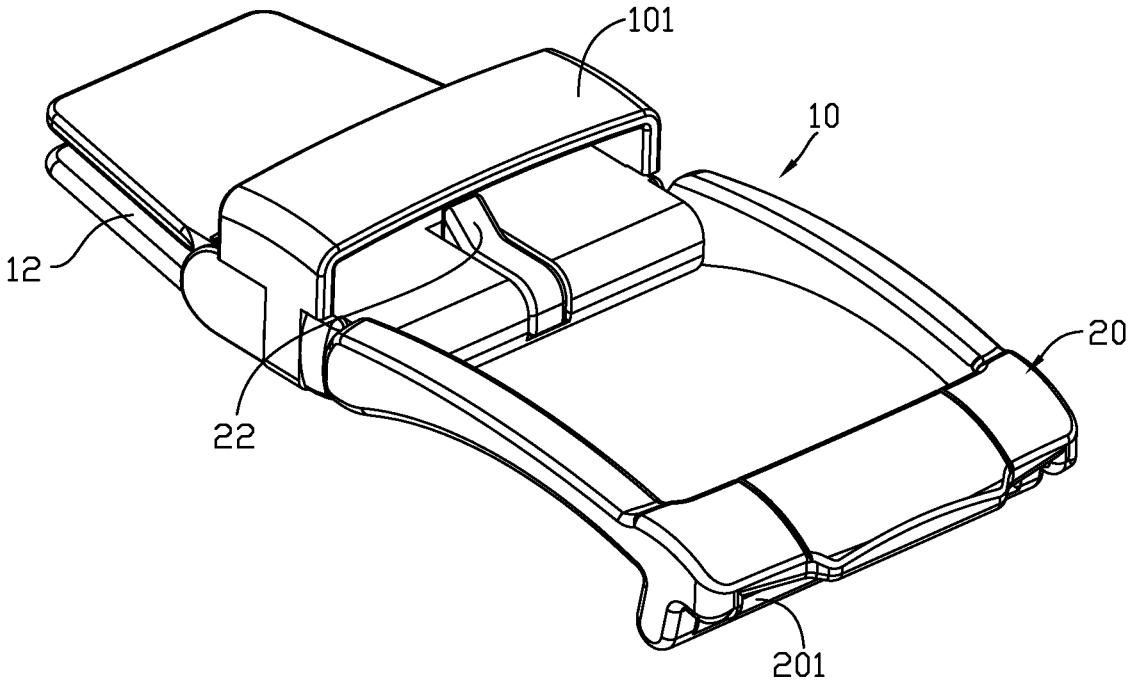
FIG. 1 is a perspective view showing a preferred embodiment of the present invention.
Figure 2:
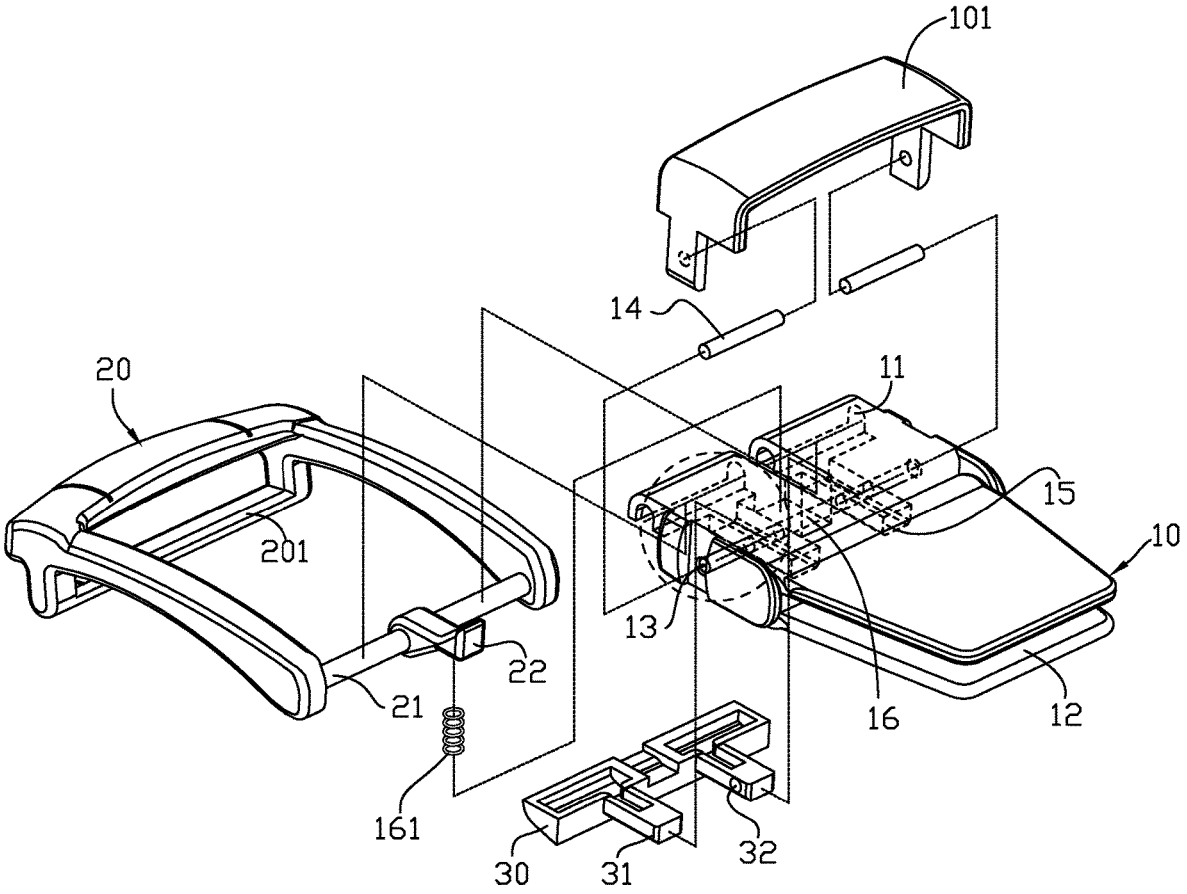
FIG. 2 is an exploded view of the preferred embodiment of the present invention.
Figure 3:
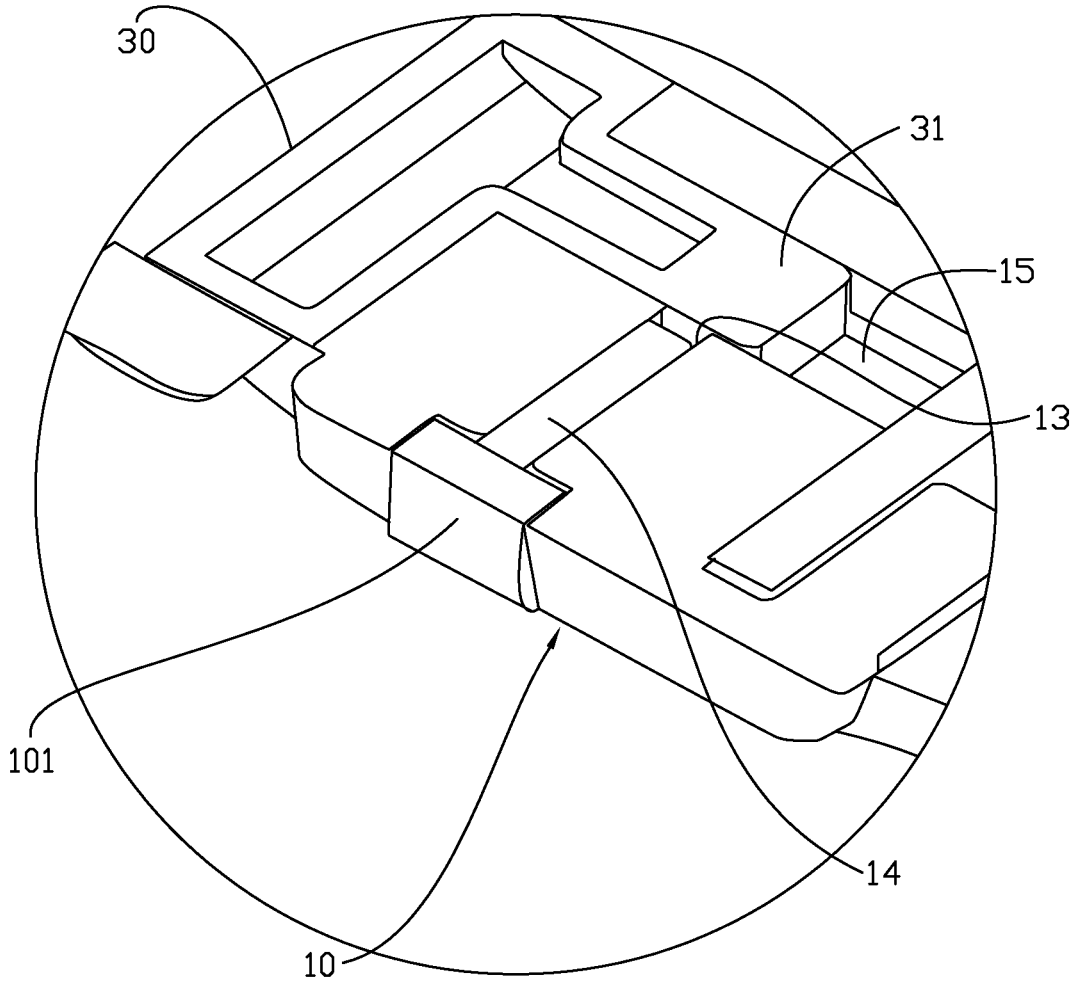
FIG. 3 is a sectional view, in an enlarged form, of a portion of the preferred embodiment of the present invention shown in FIG. 2.

The present invention provides a belt buckle structure, which, as shown in FIGS. 1-3, comprises: a buckle body 10 and a plate-based controller 20. The buckle body 10 has a front end that is provided with a coupling section 11 and a rear end that is provided with a connection section 12 that is connectable to a belt 40. The coupling section 11 is formed, in a central portion of a top side thereof, with a pivoting notch 16, and the coupling section 11 is also formed, in an internal portion of a bottom side thereof, with two recesses 15. Further, the buckle body 10 is formed, in each of two opposite sides thereof, with a pin hole 13.

The plate-based controller 20 is integrally formed as a unitary structure. The plate-based controller 20 is provided, on an end thereof, with a coupling axle 21 that comprises a pawl 22 mounted thereto. The coupling axle 21 is arranged in the coupling section 11. A fixing member 30 is formed with a protruding section 31 to be fit into each of the recesses 15, and at least one pin 14 is received through the pin hole 13 at one side of the buckle body to penetrate through the recess 15 and extend into a positioning hole 32 formed in the fixing member 30. A primary constraint frame 101 has two opposite side portions that are arranged in collaboration with the pin 14 to attach to the two sides of the buckle body 10. The pivoting notch 16 is provided with an elastic element 161 disposed therein to elastically push or bias the pawl 22. The plate-based controller 20 is rotatable with respect to the buckle body 10. All the parts are not exposed so that protectability and aesthetics of the overall structure can be improved.

Figure 4:
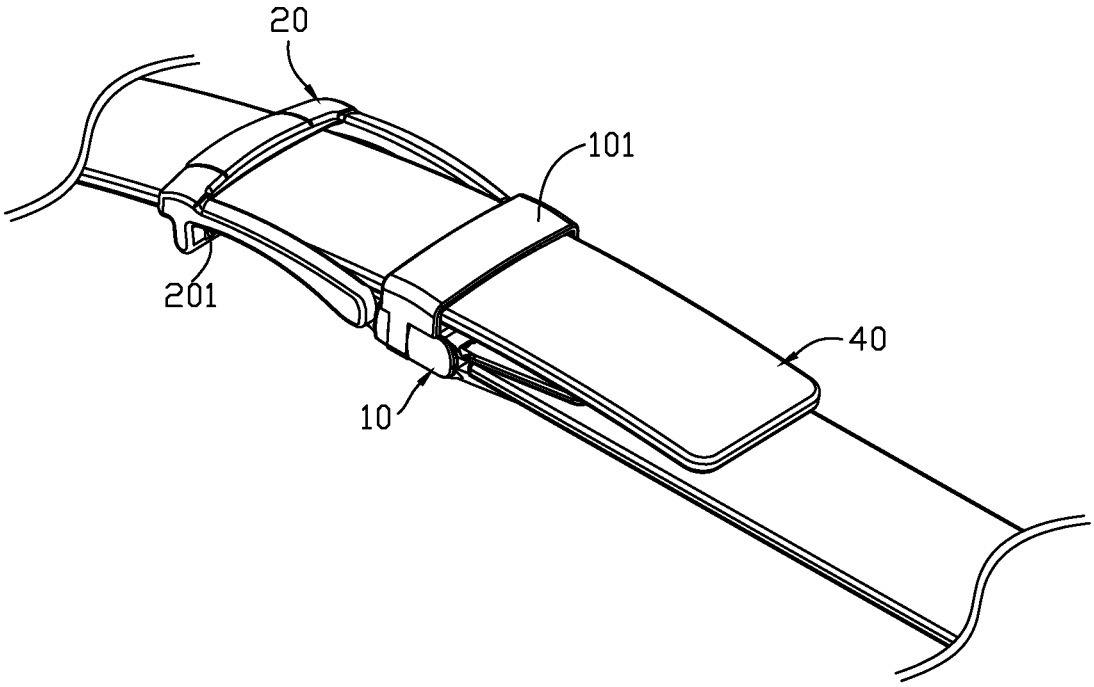
FIG. 4 is a schematic view illustrating the preferred embodiment of the present invention used with a belt attached thereto.
Figure 5:
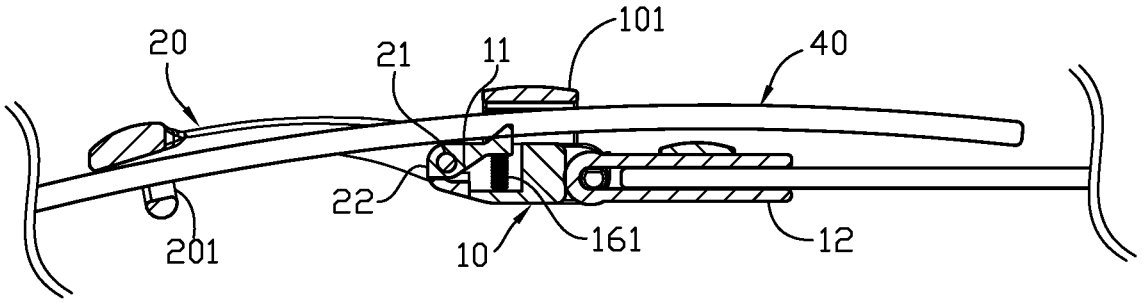
FIG. 5 is a cross-sectional view of the preferred embodiment of the present invention shown in FIG. 4.
Figure 6:
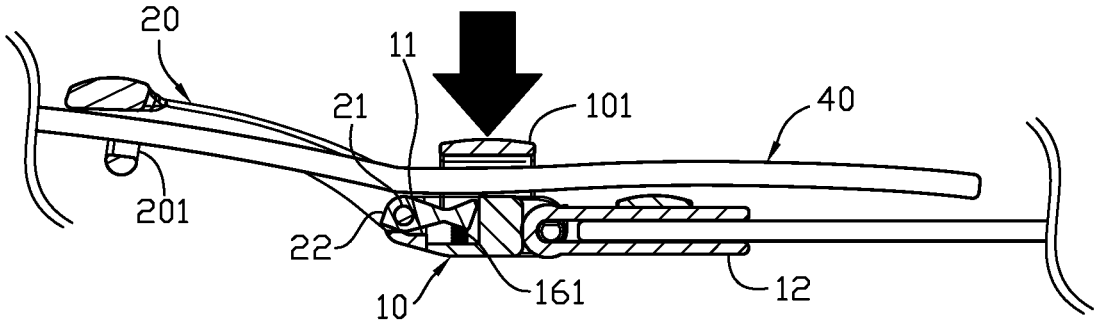
FIG. 6 is a schematic view demonstrating adjustment conducted through pressing a master constraint frame of the preferred embodiment of the present invention shown in FIG. 5.

Referring to FIGS. 4-6, the belt 40, which is a toothed belt, is connected to the connection section 12 of the buckle body 10. The belt 40 is formed with multiple teeth 41. The plate-based controller 20 is provided, at an end thereof, with a secondary constraint frame 201, which receives a tail end section of the toothed belt 40 to extend therethrough to further insert into the primary constraint frame 101. When an external force is applied to press down the primary constraint frame 101, the buckle body 10 is pushed toward the waist of a human body and in turn provides a supporting effect so that the plate-based controller 20 is caused to drive the pawl 22 to move upward and downward in the pivoting notch 16. The elastic element 13 that is arranged in the pivoting notch 16 can be a helical spring, a plate spring, or the likes. When the pawl 22 is moved upward, engagement with the teeth 41 is achieved and the tail end section of the toothed belt 40 is set in a condition of being fixed; and when the pawl 22 is moved downward and disengagement from the teeth 41 is made so that the tail end section of the toothed belt 40 is in a condition of being not fixed and thus, adjustment can be made thereto.

In summary, the belt buckle structure of the present invention is made to primarily includes an integrally formed plate-based controller 20, which is pivotally or rotatably coupled with a coupling section 11 of a buckle body 10, wherein a protruding section 31 formed on a fixing member 30 is fit into a recess 15 formed in the buckle body 10; a pin 14 is received through a pin hole 13 to penetrate through the recess 15 and extend into a positioning hole 32 formed in the fixing member 30; two side portions of a primary constraint frame 101 are arranged in collaboration with the pin 14 to attach to two sides of the buckle body 10; and an elastic element 161 is disposed in the pivoting notch 16 to push or bias a pawl 22, so that the plate-based controller 20 is made rotatable relative to the buckle body 10 with all the parts being concealed and not exposed and thus, protectability of the overall structure is improved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A belt buckle structure, comprising: a buckle body and a plate-based controller, the buckle body having a front end comprising a coupling section and a rear end comprising a connection section for connecting a toothed belt, the coupling section being formed with a pivoting notch in a central portion of a top side thereof, the coupling section being formed with a recess in an internal portion of a bottom side thereof, the buckle body being formed with a pin hole on two sides thereof, wherein the plate-based controller is an integrally formed unitary structure and the plate-based controller has an end formed with a coupling axle having a pawl, the coupling axle being received in the coupling section, wherein a fixing member has a protruding section that is fit into the recess to collaborate with at least one pin that is received through the pin hole of the buckle body, penetrating through the recess to extend into a positioning hole formed in the fixing member, and two side portions of a primary constraint frame are arranged in collaboration with the at least one pin to be attached to the two sides of the buckle body, and an elastic element is disposed in the pivoting notch to bias the pawl, so as to allow the plate-based controller to selectively rotate relative to the buckle body.

2. The belt buckle structure according to claim 1, wherein the plate-based controller further comprises a secondary constraint frame, through which a tail end section of the toothed belt is received to insert into the primary constraint frame, wherein the primary constraint frame is depressible down to cause the plate-based controller to drive the pawl to move upward and downward in the pivoting notch such that the tail end section of the toothed belt is set in a fixed condition as being engaged by the pawl that is moved upward and the tail end section of the belt is set in a released and thus adjustable condition when the pawl is moved downward to disengage therefrom.

3. The belt buckle structure according to claim 1, wherein the elastic element comprises a spring.

4. The belt buckle structure according to claim 1, wherein the elastic element comprises a plate spring.

* * * * *